US005522479A

United States Patent [19]

Jo

[11] Patent Number: 5,522,479

[45] Date of Patent: Jun. 4, 1996

[54] CONTROL VALVE DEVICE FOR HYDRAULIC ELEVATOR

[75] Inventor: Yang K. Jo, Busan, Rep. of Korea

[73] Assignee: LG Industrial Systems Co., Ltd., Seoul, Rep. of Korea

[21] Appl. No.: 325,148

[22] Filed: Oct. 20, 1994

[30] Foreign Application Priority Data

Oct. 25, 1993 [KR] Rep. of Korea ..... 22245/1993

[51] Int. Cl.[6] ..... B66B 9/04

[52] U.S. Cl. ..... 187/275; 91/454

[58] Field of Search ..... 187/253, 272, 187/275, 305; 91/454

[56] References Cited

U.S. PATENT DOCUMENTS 5,285,027 2/1994 Nakamura et al. ..... 187/275

5,374,794 12/1994 Holmes ..... 187/275

*Primary Examiner*—Kenneth Noland

*Attorney, Agent, or Firm*—Oliff & Berridge

[57] ABSTRACT

A control valve device for a hydraulic elevator including a main check valve connected between a hydraulic cylinder adapted to ascend and descend a car of the hydraulic elevator and a hydraulic pump adapted to pump a pressurized oil, a cylinder-side pressure detector disposed between the hydraulic cylinder and the main check valve and adapted to detect a pressure in side of the hydraulic cylinder, a pump-side pressure detector disposed between the main check valve and the hydraulic pump and adapted to detect a pressure in side of the hydraulic pump, an opening solenoid valve connected between the main check valve and the hydraulic pump and adapted to receive a pilot pressure generated only from a pressure generated by the hydraulic pump and open the main check valve in response to the pilot pressure, and a closing solenoid valve connected to the main check valve and adapted to close the main check valve opened by the opening solenoid valve.

10 Claims, 5 Drawing Sheets

CONTROL VALVE DEVICE FOR HYDRAULIC ELEVATOR

BACKGROUND OF THE INVENTION

1. Field of the Invention

The present invention relates to a control valve device for a hydraulic elevator, and more particularly to a control valve device for a hydraulic elevator capable of controlling an RPM of a hydraulic pump and thereby controlling the delivery of a pressurized fluid to a hydraulic cylinder or the quantity of a pressurized fluid discharged out of the hydraulic cylinder.

2. Description of the Prior Art

FIG. 1 is a circuit diagram illustrating a conventional control valve device for a hydraulic elevator. In FIG. 1, the reference numeral 1 denotes a car for carrying passengers, while the reference numeral 2 denotes a main rope fixedly mounted at one end thereof to the ground and connected at the other end thereof to the car 1. The main rope 2 extends between the ground and the car 1 via a pulley 3 coupled to the upper end of a ram 4*a* upward spaced a certain distance apart from the ground. The ram 4*a* is received in a hydraulic cylinder 4. To the hydraulic cylinder 4, a hydraulic hose 5 is connected at one end thereof. The other end of the hydraulic hose 5 is connected to a pilot operating main check valve 6.

On the other hand, a pressure detecting unit 21 is provided between the hydraulic cylinder 4 and the main check valve 6 to detect a pressure in side of the hydraulic cylinder 4.

The main check valve 6 is connected at one end thereof to a pilot line 10. On the pilot line 10, an opening solenoid valve 8 and a closing solenoid valve 9 are positioned and spaced an appropriate distance apart from each other. The closing solenoid valve 9 is connected to an oil tank 20 which is disposed beneath the closing solenoid valve 9.

To the main check valve 6, a normal/reverse rotation hydraulic pump-side pressure detecting unit 22 is connected so as to detect the pressure of a normal/reverse rotation hydraulic pump 17. A pilot operating unload relief valve 12 is connected to the hydraulic pump-side pressure detecting unit 22. The pilot operating unloading relief valve 12 serves as a safety valve and operates to obtain a required pressure. Connected to the pilot operating unloading relief valve 12 is a throttle valve 11, to which an unloading solenoid valve 14 is connected. A relief valve 13 is also connected to the pilot operating unloading relief valve 12.

At the downstream of the relief valve 13 and the solenoid valve 14, a check valve 15 is disposed which serves to allow a pressurized oil emerging from each of the relief valve 13 and the solenoid valve 14 to flow only in one direction. The check valve 15 prevents the pressurized oil from flowing the other direction.

On the other hand, a three-phase induction motor (variable motor) 19 is connected to the normal/reverse rotation hydraulic pump 17. An oil filter 18 is connected to the normal/reverse rotation hydraulic pump 17. The oil filter 18 serves to filter an oil (operating fluid) emerging from the normal/reverse rotation hydraulic pump 17. The oil tank 20 receives the filtered oil from the filter 18 and stores it therein.

To the three-phase induction motor 19, an inverter 24 is connected. The inverter 24 is also connected to a speed control unit 23. The speed control unit 23 is coupled to the pressure detecting unit 21 in side of the hydraulic cylinder 4 and to the pressure detecting unit 22 in side of the hydraulic pump 17 so that it receives a pressure signal detected by the pressure detecting unit 21 and a pressure signal detected by the pressure detecting unit 22 respectively via output signal transmission lines 21*a* and 22*a*.

Operation of the conventional control valve device having the above-mentioned arrangement will now be described.

When an ascending operation command for the car 1 is generated by an operator, the cylinder-side pressure detecting unit (for example, a pressure sensor) 21 performs its detecting operation to detect a cylinder-side pressure and generates a signal indicative of the detected pressure. The pressure signal from the cylinder-side pressure detecting unit 21 is sent to the speed control unit 23 via the output signal transmission line 21*a*. Simultaneously, the pump-side pressure detecting unit 22 performs its detecting operation to detect a pump-side pressure and generates a signal indicative of the detected pressure. The pressure signal from the pump-side pressure detecting unit 22 is also sent to the speed control unit 23 via the output signal transmission line 22*a*. The pressure detected in side of the hydraulic cylinder 4 is determined as a reference pressure. After completing the detection of the reference pressure, the speed control unit 23 generates a motor drive signal using the pressure signal from the pump-side pressure detecting unit 22 as a feedback signal, so as to make the delivery pressure of the hydraulic pump 17 to correspond to the reference pressure. The motor drive signal from the speed control unit 23 is applied to the inverter 24 which, in turn, generates a three-phase variable AC voltage of a variable frequency corresponding to the drive signal. The AC voltage is applied to the three-phase induction motor 19, thereby enabling the three-phase induction motor 19 to be driven. By the drive force of the three-phase induction motor 19, the hydraulic pump 17 operatively connected to the induction motor 19 rotates normally, so that it increases in delivery pressure. When the delivery pressure of the hydraulic pump 17 detected by the pump-side pressure detecting unit 22 reaches the reference pressure, the speed control unit 23 generates a speed command corresponding to the speed command for the car 1 so as to control the rotation speed of the induction motor 19. As the rotation speed of the induction motor 19 increases, the delivery oil quantity of the hydraulic pump 17 increases, so that the pressurized oil emerging from the hydraulic pump 17 can rise while pushing the pilot operating main check valve 6. The pressurized oil passing through the check valve 6 is fed to the hydraulic cylinder 4 via the hydraulic hose 5, thereby causing the car 1 to move upward. When the car 1 approaches to a desired stop floor, the rotation speed of the induction motor 19 is decreased until the delivery oil quantity of the hydraulic pump 17 is zero. Under this condition, the hydraulic cylinder 4 discharges the pressurized oil no longer because the main check valve 6 serves as a general check valve. As a result, the car 1 is stopped.

On the other hand, where a descending operation command for the car 1 is generated by the operator, the normal rotation of the induction motor 19 is achieved in the same manner as in the ascending operation. In this case, the opening solenoid valve 8 is switched to its ON state when the delivery pressure of the hydraulic pump 17 corresponds to the pressure in side of the hydraulic cylinder 4. At this time, the closing solenoid valve 9 is also switched to its ON state. Under this condition, the pressure always generated in the hydraulic cylinder 4 by the weight of the car 1 is applied to an oil quantity control chamber 7 defined in the main check valve 6 via the pilot pipe 10. That is, the pressurized oil from the hydraulic cylinder 4 is fed to the oil quantity control chamber 7, thereby causing the main check valve 6 to shift to its left position. At the left position of the main check valve 6, the pressurized oil from the hydraulic cylinder 4 flows to the hydraulic pump 17 in accordance with the speed command for the car 1. As a result, the car 1 can move downward. During the downward movement of the car 1, the rotation of the hydraulic pump 17 is braked by the induction motor 19 to control the delivery oil quantity of the hydraulic cylinder 4.

When the car 1 approaches to a desired stop floor, the rotation speed of the induction motor 19 is decreased so as to decrease the delivery oil quantity of the hydraulic cylinder 4. When the car 1 reaches the stop floor, the opening solenoid valve 8 is switched to its OFF state. At the OFF state of the opening solenoid valve 8, the pressurized oil from the oil quantity control chamber 7 of the main check valve 6 is discharged to the oil tank 20. The closing solenoid valve 9 is also switched to its OFF state, thereby causing the main check valve 6 to be switched to a state that it performs a complete check valve function.

Meanwhile, when the delivery pressure of the hydraulic pump 17 is higher than a predetermined pressure of the pilot operating unloading relief valve 12, the pressurized oil emerging from the hydraulic pump 17 passes through the relief valve 12. As a result, the pressurized oil is stored in the oil tank 20 after passing through a conduit 16 connected to the oil tank 20.

When the temperature of the operating oil is lower than a temperature in a rated use of the operating oil, the unloading solenoid valve 14 is switched to its ON state. At the ON state of the unloading solenoid valve 14, the operating oil, that is, the pressurized oil is allowed to pass through the relief valve 12, so that the temperature of the pressurized oil is increased. Where the opening solenoid valve 8 does not operate even though it is applied with an operating signal upon descending the car 1, a cavitation may occur due to a negative pressure generated upon a reverse rotation of the hydraulic pump 17. In order to avoid such a cavitation, the relief check valve 15 is opened in response to the generation of negative pressure so that the operating oil from the oil tank 20 can be supplied to the hydraulic pump 17.

Since a pilot pressure from the hydraulic cylinder 4 is applied to the main check valve 6 via a pilot line 10, the main check valve 6 is maintained at a forcedly opened state, if the opening solenoid valve 8 is maintained at its ON state due to its abnormal operation. In the conventional hydraulic elevator, accordingly, the car 1 may have a danger of a continued descent of the car 1. When the viscosity of the pressurized oil is degraded due to an increase in temperature of the pressurized oil, a spool of the main check valve 6 may not perform the complete check valve function, thereby causing an internal leakage to occur in the main check valve 6. As a result, an undesirable descent of the car 1 may occur. In other words, the main check valve 6 may not perform its check valve function upon a variation in viscosity of the pressurized oil. Furthermore, the conventional control valve device has no valve for manually descending the car 1 in an emergency. For manually descending the car 1 in the conventional case, the pilot operating main check valve 6 should be used. This use of the main check valve 6 is dangerous.

SUMMARY OF THE INVENTION

Therefore, an object of the invention is to provide a control valve device for a hydraulic elevator capable of preventing a forced opening of a pilot operating main check valve due to an abnormal operation of an opening solenoid valve, preventing an internal leakage occurring in the main check valve due to an increase in temperature of an operating fluid, preventing a main rope from being separated from a pulley mounted to a hydraulic cylinder by the provision of a manual valve for an emergency descent and a minimum pressure-setting relief valve, and preventing a cavitation from occurring upon an abnormal rotation of a hydraulic pump.

In accordance with the present invention, this object can be accomplished by providing a control valve device for a hydraulic elevator adapted to control an oil quantity supplied to a hydraulic cylinder and an oil quantity discharged out of the hydraulic cylinder by a control of an RPM of a normal/reverse rotation hydraulic pump and thereby control ascending and descending of a car of the hydraulic elevator directly or indirectly, comprising: a main check valve connected between the hydraulic cylinder and the hydraulic pump; cylinder-side pressure detecting means disposed between the hydraulic cylinder and the main check valve and adapted to detect a pressure in side of the hydraulic cylinder; pump-side pressure detecting means disposed between the main check valve and the hydraulic pump and adapted to detect a pressure in side of the hydraulic pump; an opening solenoid valve connected between the main check valve and the hydraulic pump and adapted to receive a pilot pressure generated only from a pressure generated by the hydraulic pump and open the main check valve in response to the pilot pressure; and a closing solenoid valve connected to the main check valve and adapted to close the main check valve opened by the opening solenoid valve.

BRIEF DESCRIPTION OF THE DRAWINGS

Other objects and aspects of the invention will become apparent from the following description of embodiments with reference to the accompanying drawings in which:

FIGS. 3A to 3D are sectional views respectively illustrating various operation conditions of a main check valve, an opening solenoid valve and a closing solenoid valve which constitute an essential part of the control valve device in accordance with the present invention, wherein FIG. 3A shows an operation condition when the elevator is stopped, FIG. 3B an operation condition in a descending operation, FIG. 3C an operation condition in an ascending operation, and FIG. 3D an operation condition when the opening solenoid valve is activated.

DETAILED DESCRIPTION OF THE PREFERRED EMBODIMENTS

Figure 2:
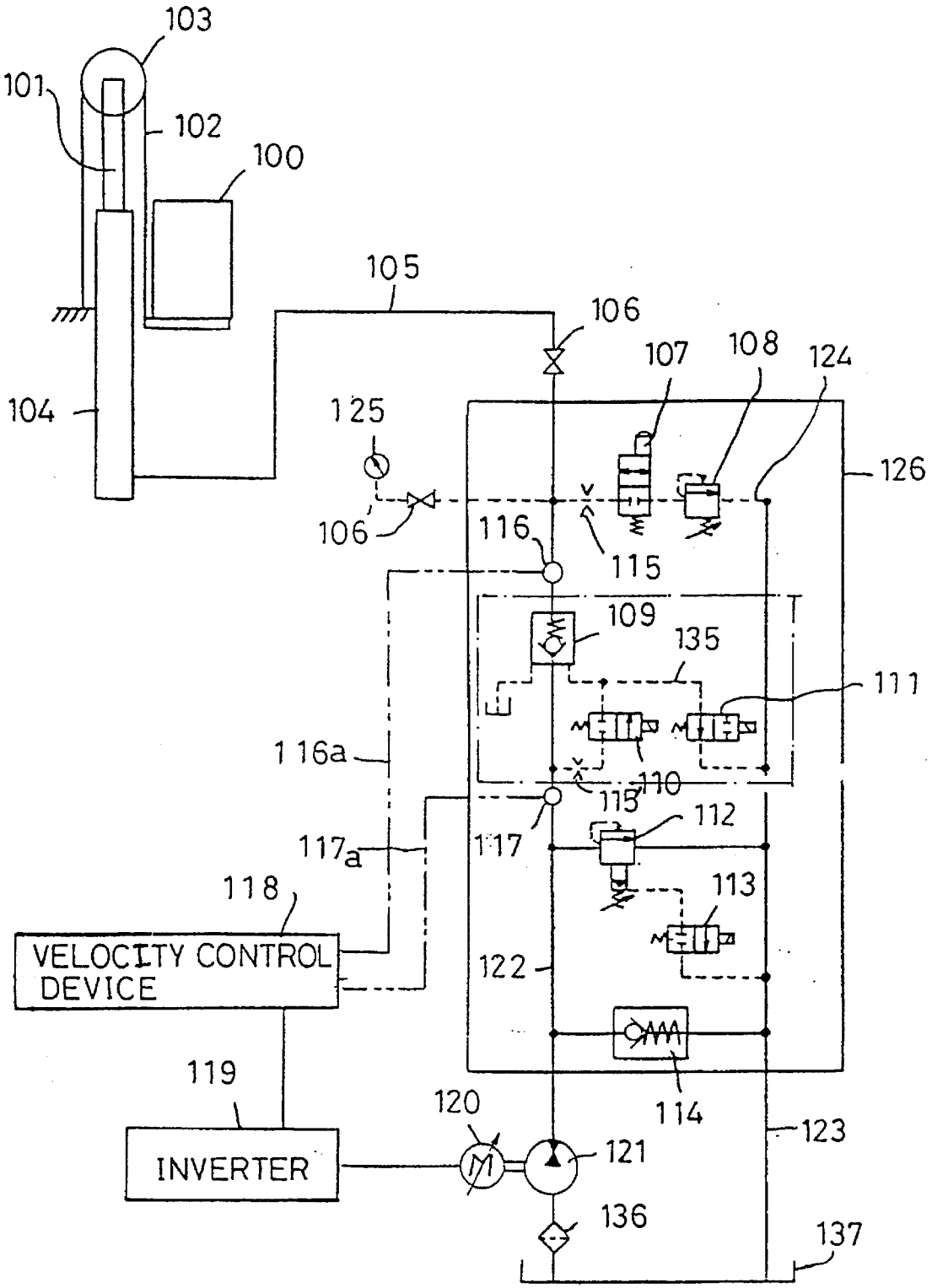
FIG. 2 is a circuit diagram illustrating a control valve device for a hydraulic elevator in accordance with the present invention.

FIG. 2 is a circuit diagram illustrating a control valve device for a hydraulic elevator in accordance with the present invention.

Figure 1:
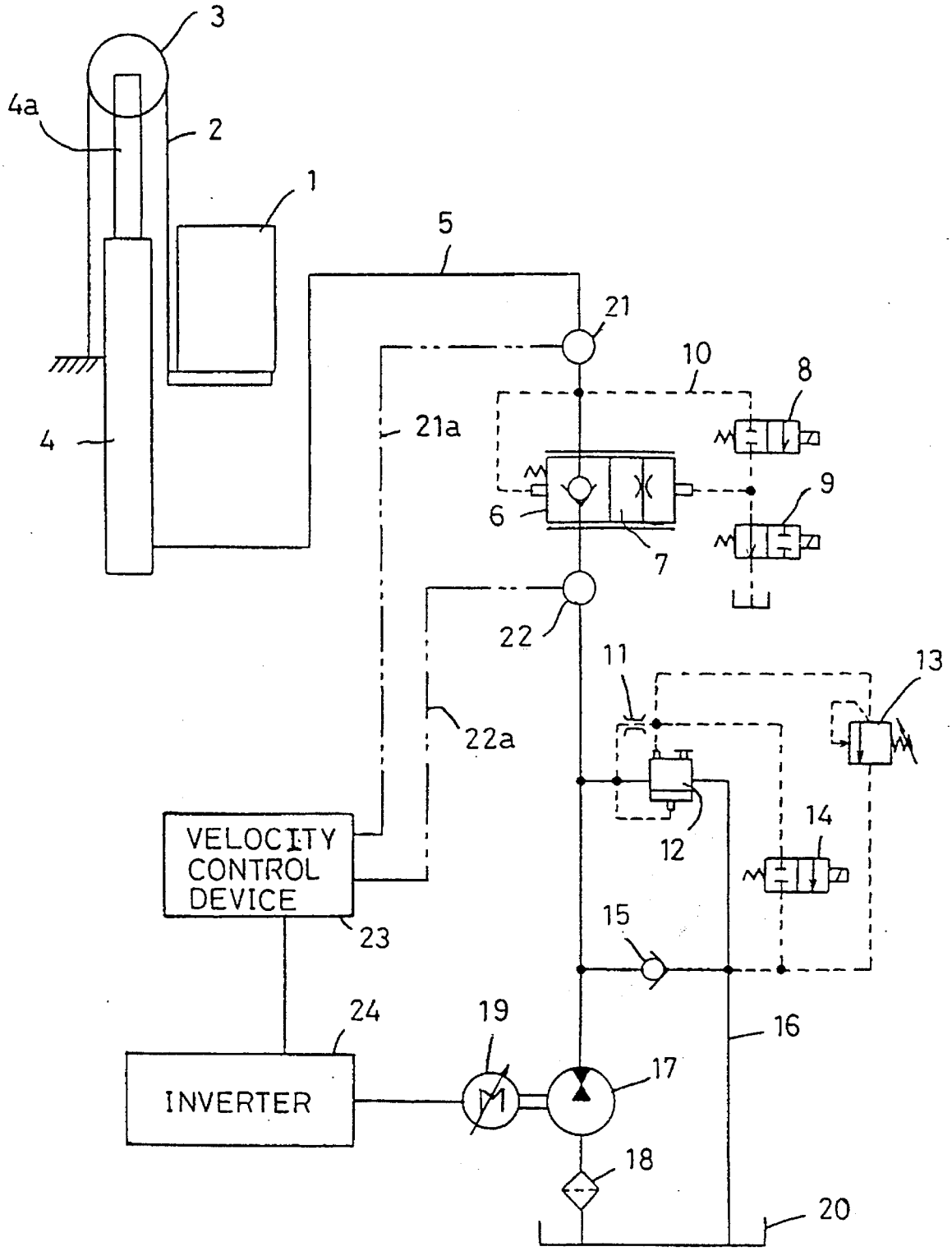
FIG. 1 CONVENTIONAL ART
FIG. 1 is a circuit diagram illustrating a conventional control valve device for a hydraulic elevator.

In FIG. 1, the reference numeral 100 denotes a car for carrying passengers. The car 100 has the same connection construction as that of the car 1 described hereinbefore in conjunction with the conventional control valve device. That is, the car 100 is connected to a main rope 102 extending between the ground and the car 100 via a pulley 103 coupled to the upper end of a ram 101. The ram 101 is received in a hydraulic cylinder 4 such that it reciprocates vertically.

The hydraulic cylinder 104 is connected to a manifold block 126 via an one-directional hydraulic hose 105. By this construction, the car 100 moves in an ascending direction when a pressurized fluid, namely, a pressurized oil is supplied in the hydraulic cylinder 104. When the pressurized oil in the hydraulic cylinder 104 is discharged, the car 100 moves in a descending direction.

A three-phase induction motor 120 is disposed beneath the manifold block 126. To the three-phase induction motor 120, a normal/reverse rotation hydraulic pump 121 is connected. The normal/reverse rotation hydraulic pump 121 is connected to the manifold block 126 via a conduit line 122. An oil filter 136 is connected to the normal/reverse rotation hydraulic pump 121. The oil filter 136 serves to filter an oil emerging from the normal/reverse rotation hydraulic pump 121. An oil tank 137 is disposed beneath the oil filter 136 such that it receives the filtered oil from the filter 136 and stores it therein.

Now, constituting elements of the control valve device arranged in the manifold block 126 will be described.

On the conduit line 122 upwardly extending from the hydraulic pump 121 in the manifold block 126, a main check valve 109 is provided. To one side portion (right portion in FIG. 2) of the main check valve 109, a check valve-opening solenoid valve 110 and a check valve-closing solenoid valve 111 are connected via a conduit line 135, indicated by a dotted line in FIG. 2, extending from the main check valve 109. The opening solenoid valve 110 is also connected to the conduit line 122. The closing solenoid valve 111 is also connected to a conduit line 123 opened to the oil tank 137. Between the opening solenoid valve 110 and the conduit line 122, a pilot line is connected. An orifice 115' is installed in the pilot line. A pilot operating relief valve 112 is also provided which is connected at one end thereof to the hydraulic pump 121 via the conduit line 122. The pilot operating relief valve 112 is also connected at the other end thereof to the oil tank 137. The pilot operating relief valve 112 serves to allow the pressurized oil from the hydraulic pump 121 to flow to the oil tank 137 when the delivery pressure of the hydraulic pump 121 is higher than a predetermined pressure. To the pilot operating relief valve 112, an unloading solenoid valve 113 is connected. The unloading solenoid valve 113 serves to open the pilot operating relief valve when the temperature of the pressurized oil is lower than a temperature in a rated use of the pressurized oil. A check valve 114 is also provided which is connected at one end thereof to the conduit line 122 and at the other end thereof to the conduit line 123. The check valve 114 serves to allow the pressurized oil from the oil tank 123 to flow toward the hydraulic pump 121 when a negative pressure is generated upon a reverse rotation of the hydraulic pump 17.

The conduit lines 122 and 123 are connected in common to the oil tank 137.

To the hydraulic cylinder 104, a manual valve 107 for an emergency descent is connected which is manually operated by an operator to allow the pressurized oil from the hydraulic cylinder 104 to be discharged to the oil tank 137, thereby descending the car 100. Between the manual valve 107 and the oil tank 137, a minimum pressure-setting relief valve 108 is provided. An orifice 115 for a pressure compensation is disposed between the hydraulic cylinder 104 and the manual valve 107. The orifice 115 is also connected to one end of a stop valve 106'. To the other end of the stop valve 106', a pressure gauge 125 is connected. The minimum pressure-setting relief valve 108 is a safety valve for preventing the main rope 102 from being separated from the pulley 103 due to an abrupt descent of the ram 101 of hydraulic cylinder 104 generated upon opening the manual valve 107 for emergency descent. To this end, the minimum pressure-setting relief valve 108 is adapted to be opened at a minimum pressure predetermined to be slightly higher than the weight of the car including the weight of the ram 101, taking the weight of passengers into consideration. Accordingly, the car 100 can not descend only by the weight thereof. On the other hand, the orifice 115 is a throttle valve for maintaining the speed of car 100 at a low level upon manually descending the car 100.

Between the hydraulic cylinder 104 and the main check valve 106, a stop valve 106 is connected. The stop valve 106 is provided for the safety. The stop valve 106 is closed where the elevator is not operated for a long time or where maintenance or replacement of valves is required. In a normal condition (a standby state for operation or an operating state), the stop valve 106 is maintained at its opened state.

On the other hand, a cylinder-side pressure detector 116 is provided between the stop valve 106 and the main check valve 6 to detect a pressure in side of the hydraulic cylinder 104. Also, a pump-side pressure detector 117 is provided between the main check valve 109 and the normal/reverse rotation hydraulic pump 121 to detect a pressure in side of the hydraulic pump 121.

In FIG. 2, the reference numeral 118 denotes a speed control unit to which both the cylinder-side pressure detector 116 and the pump-side pressure detector 117 are connected via output signal transmission lines 116*a* and 117*a*, respectively. An inverter 119 is also connected to the speed control unit 118. To the inverter 119, a three-phase induction motor 120 is connected which is a variable motor.

FIGS. 3A to 3D are sectional views of various operation conditions of a part (a rectangular portion indicated by a dotted dash line) of the manifold block 126 shown in FIG. 2, respectively. In FIGS. 3A to 3D, operative connections among the main check valve 109, the opening solenoid valve 110 and the closing solenoid valve 111 are shown.

Figure 3A:
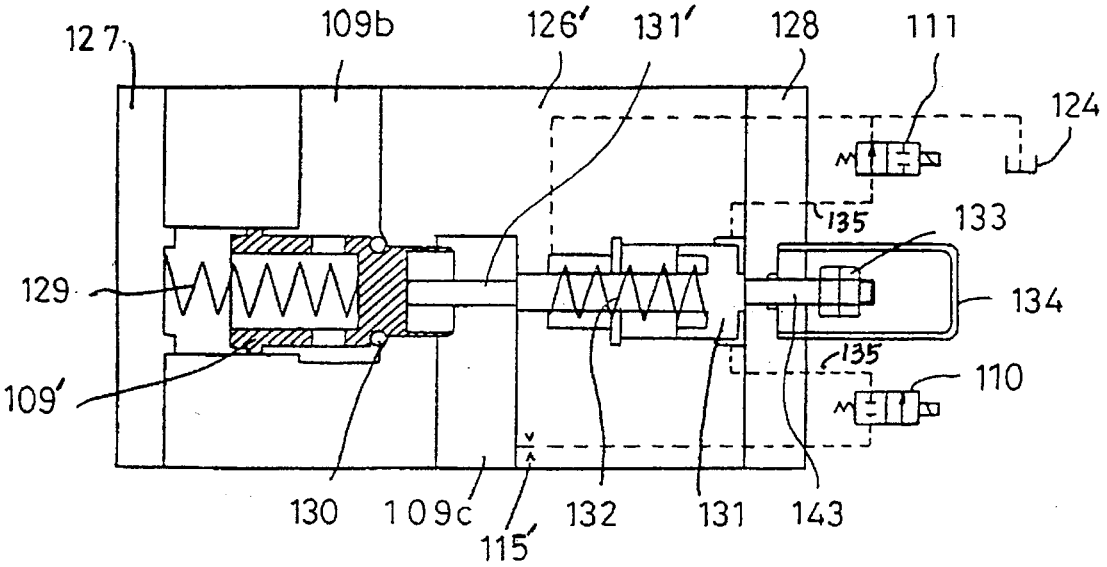
Figure 3B:
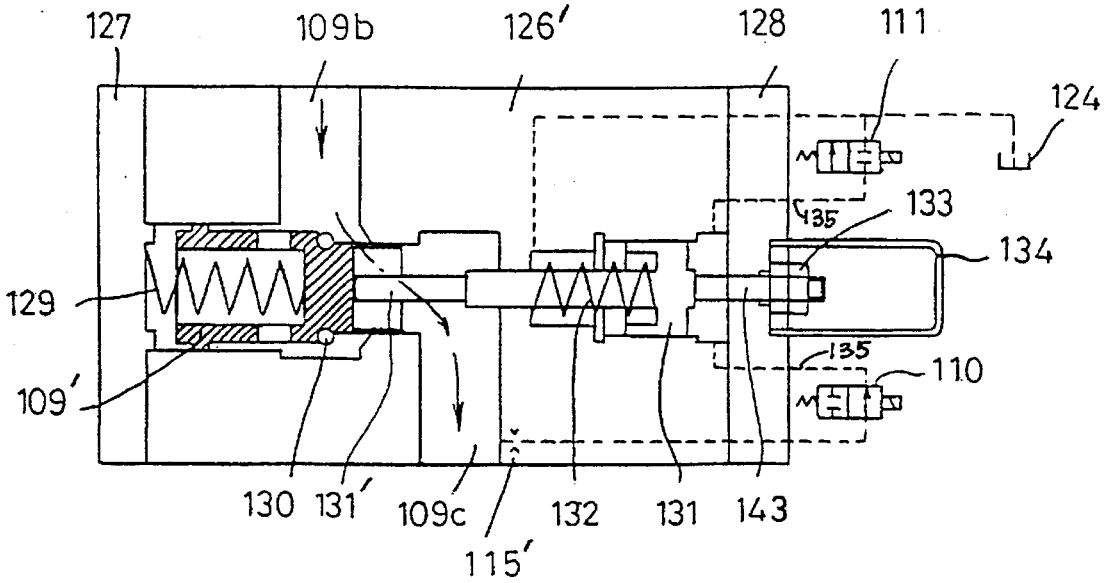

As shown in FIG. 3A, the block portion of the manifold block 126 indicated by the dotted dash line includes a main block 126' and a manifold block cover 127. For the convenience of understanding, the opening solenoid valve 110 and the closing solenoid valve 11 are shown at the right portion of each of FIGS. 3A to 3D.

The main check valve 109 has a movable member 109' centrally disposed at the left portion of the manifold block 126. In right of the movable member 109', a piston 131 is disposed which is movable left and right by pilot pressures respectively applied to its opposite end surfaces. From the piston 131, a piston rod 131' extends toward the movable member 109'. The piston rod 131' serves to push the movable member 109' in the left direction by the pilot pressure applied to the right end surface of the piston 131. Around the piston rod 131', a compression coil spring 132 is disposed to always bias the piston 131 in the right direction. Another compression coil spring 129 is disposed between an inner wall 129' of the movable member 109' and the manifold block cover 127. The compression coil spring 129 serves to always bias the movable member 109' in the right direction to close the check valve 109.

Manifold block covers 127 and 128 are coupled to both ends of the manifold block 126, respectively. To one end (right end) of the piston 131, a stopper nut 133 is threadedly coupled. A protection cover 134 is fixedly mounted to the manifold block cover 128 so as to protect the stopper nut 133. The stopper nut 133 serves to limit the stroke of the piston 131 and thereby the stroke of the movable member 109' in order to adjust the opened degree of the main check valve 109.

Figure 4:
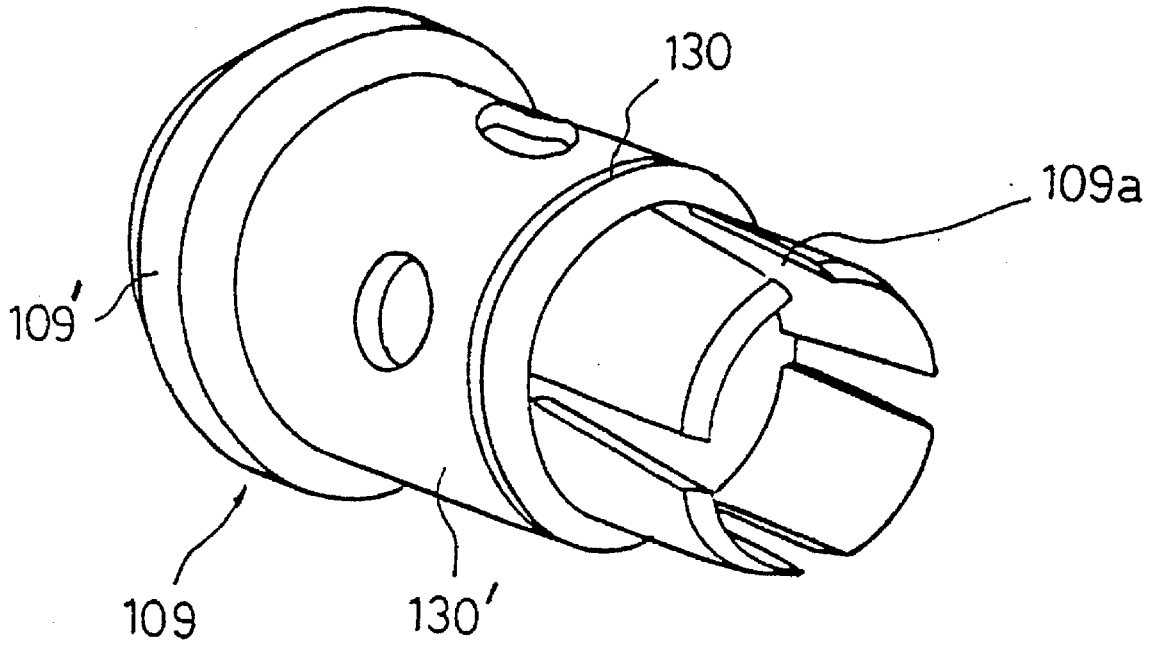
FIG. 4 is a perspective view of the main check valve in accordance with the present invention.

As shown in FIG. 4, an urethane O-ring 130 is fitted around a cylindrical body 130' of the movable member 109'. The urethane O-ring 130 serves to prevent an internal leakage of pressurized oil from occurring in the check valve 109. The movable member 109' has a plurality of slots **109*a* at one end thereof. Through the slots 109*a*, the pressurized oil can pass. Although the movable member 109' has four slots 109*a*** in the illustrated case, the number of slots is not limited thereto.

In FIGS. 3A to 3D, the reference numeral **109*b* denotes an oil port in side of the hydraulic cylinder 104 whereas the reference numeral 109*c* denotes an oil port in side of the normal/reverse rotation hydraulic pump 121**.

Operation of the conventional control valve device having the above-mentioned arrangement will now be described.

Upon Ascending Car

When an ascending operation command for the car 100 is generated, the cylinder-side pressure detector 116 performs its detecting operation to detect a load pressure and generates a signal indicative of the detected pressure. The pressure signal from the cylinder-side pressure detector 116 is sent to the speed control unit 118 via the output signal transmission line **116*a*. Simultaneously, the pump-side pressure detector 117 performs its detecting operation to detect a delivery pressure and generates a signal indicative of the detected pressure. The pressure signal from the pump-side pressure detector 117 is also sent to the speed control unit 118 via the output signal transmission line 117*a*. Based on the received pressure signals, the speed control unit 118 generates a speed command for the three-phase induction motor 120 and sends it to the inverter 119 serving to perform an inverse conversion of DC into AC. Upon receiving the speed command for the induction motor 120, the inverter 119 generates a three-phase variable AC voltage of a variable frequency corresponding to the received speed command so as to drive the induction motor 120. For controlling the induction motor 120, the load pressure detected by the cylinder-side pressure detector 116 (this detection is made at the beginning of every driving of the induction motor 120 because the load pressure is always variable depending on the number of passengers) is determined as a reference pressure. That is, the induction motor 120 is controlled to normally rotate the hydraulic pump 121 until the delivery pressure of the hydraulic pump 121 reaches the reference pressure. When the delivery pressure of the hydraulic pump 121 corresponds to the reference pressure, the rotation speed of the induction motor 120 is controlled by adding a speed command corresponding to the speed command for the car 100 to a current rotation speed of the induction motor 120**.

Figure 3C:
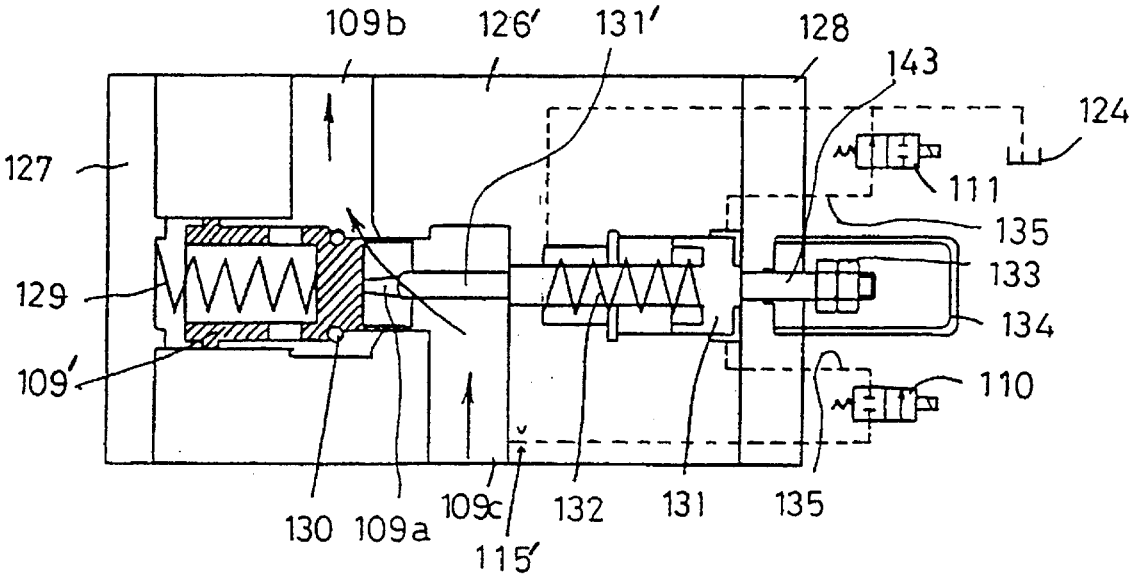

As the rotation speed of the induction motor 120 increases, the delivery oil quantity of the hydraulic pump 121 increases (the delivery oil quantity of the hydraulic pump 121 is zero until the delivery pressure of the hydraulic pump 121 reaches the pressure in side of the hydraulic cylinder 104), so that the pressurized oil emerging from the hydraulic pump 121 can rise along the conduit line 122 while pushing the movable member 109' of the main check valve 109. The pressurized oil from the hydraulic pump 121 passing through the check valve 109 is fed to the hydraulic cylinder 104 via the hydraulic hose 105 while passing through the stop valve 106 normally opened, thereby causing the ram 101 to move upward. As a result, the car 100 ascends. In other words, the movable member 109' of the main check valve 109 is pressed in the left direction against the spring force of the spring 129 by the pressurized oil, thereby causing the cylinder-side oil port **109*b* and the pump-side oil port 109*c* to communicate with each other, as shown in FIG. 3C. Accordingly, the pressurized oil from the hydraulic pump 121 can be fed to the hydraulic cylinder 104 via the pump-side oil port 109*c* and the cylinder-side oil port 109*b*, as indicated by an arrow in FIG. 3C. At this time, both the opening solenoid valve 110 and the closing solenoid valve 111 are maintained at their OFF states, respectively, thereby causing the piston 131 to be maintained at its right position by virtue of the spring force of the spring 132**.

When the car 100 approaches to a desired stop floor, the speed command being applied to the induction motor 120 is decreased in level to decrease the delivery oil quantity of the hydraulic pump 121. As a result, the ascending speed of the car 100 decreases. At the point of time when the car 100 reaches the stop floor, the delivery pressure of the hydraulic pump 121 is identical to the reference pressure. At this time, the delivery oil quantity of the hydraulic pump 121 is zero. When the delivery oil quantity of the hydraulic pump 121 is zero, the movable member 109' of the check valve 109 is moved in the right direction by the spring force of the spring 129, thereby closing a passage (not shown) between the cylinder-side oil port **109*b* and the pump-side oil port 109*c*. As the delivery pressure of the hydraulic pump 121 is further decreased, the main check valve 109 is fully closed. Under this condition, the control for the induction motor 120 is completed to end the ascending operation. When the ascending operation is completed, the movable member 109' of the check valve 109 is maintained at a normal state shown in FIG. 3A. At this time, both the opening solenoid valve 110 and the closing solenoid valve 111** are maintained at their OFF states, respectively.

Upon Descending Car

On the other hand, where a descending operation command for the car 100 is generated, the normal rotation of the induction motor 120 is achieved in the same manner as in the ascending operation. In this case, both the opening solenoid valve 110 and the closing solenoid valve 111 are switched to their ON states, respectively, when the delivery pressure of the hydraulic pump 121 corresponds to the pressure in side of the hydraulic cylinder 104. Under this condition, the pressure of the hydraulic pump 121 is applied to one end surface (namely, the right end surface in FIG. 3B) of the piston 131 via the conduit line 122, the orifice 115', the pilot pipe and the solenoid valve 110. By the applied pressure, the piston 131 moves in the left direction, so that the piston rod 131' pushes the movable member 109' in the left direction, thereby causing the cylinder-side oil port **109*b* and the pump-side oil port 109*c* to communicate with each other. As a result, the pressurized oil from the hydraulic cylinder 104 can be fed toward the hydraulic pump 121 via the cylinder-side oil port 109*b* and the pump-side oil port 109*c*, as indicated by an arrow in FIG. 3**B.

In the operation upon descending the car 100, the main check valve 109 is forcedly opened in order to allow the pressurized oil to flow reversely. This will be described in detail. Where the main check valve 109 has a pressure difference between the cylinder-side oil port **109*b* and the pump-side oil port 109***c* upon releasing the check function thereof, an impact may be generated upon opening the main check valve 109. To this end, the lead pressure is detected as a reference pressure by the cylinder-side pressure detector 116 (this detection is made at the beginning of every driving of the induction motor 120 because the lead pressure is always variable depending on the number of passengers). Thereafter, the hydraulic pump 121 is driven to rotate normally until the delivery pressure of the hydraulic pump 121 corresponds to the reference pressure. When the delivery pressure of the hydraulic pump 121 corresponds to the reference pressure, both the opening solenoid valve 110 and the closing solenoid valve 111 are switched to their ON states, respectively. At the ON states of the opening solenoid valve 110 and the closing solenoid valve 111, the pressurized oil can flow freely between the hydraulic cylinder 104 and the hydraulic pump 121. The reason why the opening of the main check valve 109 upon descending the car 100 is achieved under the condition that the pressure in side of the hydraulic pump 121 corresponds to the pressure of the hydraulic cylinder 104 is to prevent a starting shock from occurring upon the descending of the car 100.

In this case, the opened degree of the main check valve 109 is limited within a predetermined range corresponding to the stroke of the piston adjustable by the stopper nut 133 threadedly coupled to the shaft 143 extending from the piston 131. Accordingly, the descending speed of the car 100 is limited appropriately.

Under the above-mentioned condition that both the opening solenoid valve 110 and the closing solenoid valve 111 are maintained at their ON states, respectively, a reference rotation speed signal for the induction motor 120 is generated by adding a speed command (negative value) to a reference speed command for the car 100. Based on the reference rotation speed signal, the induction motor 120 is controlled such that the rotation speed thereof corresponds to the reference rotation speed. In other words, the induction motor 120 is controlled to rotate normally until the opening solenoid valve 110 and the closing solenoid valve 111 are opened. When the main check valve 109 loses its check valve function in response to a generation of a valve opening command, the induction motor 120 reduces in rotation speed and then rotates reversely. Thereafter, the induction motor 120 reduces in rotation speed at a predetermined speed-reducing point. When the car 100 reaches a desired stop floor, the induction motor 120 rotates normally again. During the controlled operation of the induction motor 120, the hydraulic pump 121 is controlled such that the delivery pressure thereof corresponds to the initial reference pressure, while generating no delivery oil quantity. Under this condition, both the opening solenoid valve 110 and the closing solenoid valve 111 are switched to their OFF states, respectively, by a valve closing command. Accordingly, the main check valve 109 is returned to its state performing the check valve function. As the rotation speed of the induction motor 120 is decreased under the above-mentioned condition, the delivery pressure of the hydraulic pump 121 is less than the pressure in side of the hydraulic cylinder 104. As a result, the pressurized oil emerging from the hydraulic cylinder 104 is cut off by the main check valve 109, thereby causing the car 100 to be completely stopped. When the main check valve 104 exhibit completely the check valve function (that is, the delivery pressure of the hydraulic pump 121 is considerably less than the pressure of the hydraulic cylinder 104), the control operation for the induction motor 120 is completed. Thus, the descending operation is completed. Upon completing the descending operation, the movable member 109' of the main check valve 109 is maintained at the state shown in FIG. 3A.

Upon Descending Car in An Emergency

The case where an emergency descent of the car 100 is required corresponds to the case that the car 100 moves no longer due to a shut-off of electric power under a condition that the car 100 is stopped between floors, thereby causing passengers to be locked up in the car 100. In this case, the manual valve 107 for emergency descent is manually opened by the operator. At the opened state of the manual valve 107, the pressurized oil from the hydraulic cylinder 104 is discharged to the oil tank 137 via the hydraulic hose 105, the orifice 115, the manual valve 107 and the minimum pressure-setting relief valve 108. As a result, the car 100 moves downward. By manually closing the manual valve 107 when the car 100 reaches a desired floor, the car 100 can be stopped at the desired floor.

The manual valve 107 for emergency descent is a valve used to move downward the car 100 to a nearest floor in an emergency or in a shut-off of electric power. On the other hand, the minimum pressure-setting relief valve 108 connected to the manual valve 107 is to be opened at a predetermined minimum pressure. When the manual valve 107 is manipulated to be opened under a condition that the car 100 can not move vertically for some reasons where the predetermined minimum pressure for the relief valve 108 is set only by the weight of passengers without taking the weight of the car 100 into consideration, the main rope 102 may be separated from the pulley 103 due to the weight of the car 100. Accordingly, the predetermined minimum pressure of the minimum pressure-setting relief valve 108 is set by a pressure corresponding to the weight of passengers including the weight of the car 100 so as to prevent the main rope 102 from being separated from the pulley 103.

On the other hand, when the delivery pressure of the hydraulic pump 121 is higher than the predetermined pressure of the pilot operating relief valve 112, the pressurized oil discharged out of the hydraulic pump 121 passes through the pilot operating relief valve 121 and then flows to the oil tank 137 via the conduit line 123. When the temperature of the pressurized oil is lower than a temperature in a rated use of the pressurized oil, the unloading solenoid valve 113 is switched to its ON state. At the ON state of the unloading solenoid valve 113, the pressurized oil, that is, the operating oil is allowed to pass through the pilot operating relief valve 112, so that the temperature of the operating oil is increased to the temperature in the rated use. On the other hand, where the opening solenoid valve 110 does not operate even though it is applied with an operating signal upon descending the car 1, the cheek valve 114 is opened so that the operating oil from the oil tank 137 can be supplied to the hydraulic pump 121. Accordingly, it is possible to prevent a cavitation from occurring due to a negative pressure generated upon a reverse rotation of the hydraulic pump 17.

Figure 3D:
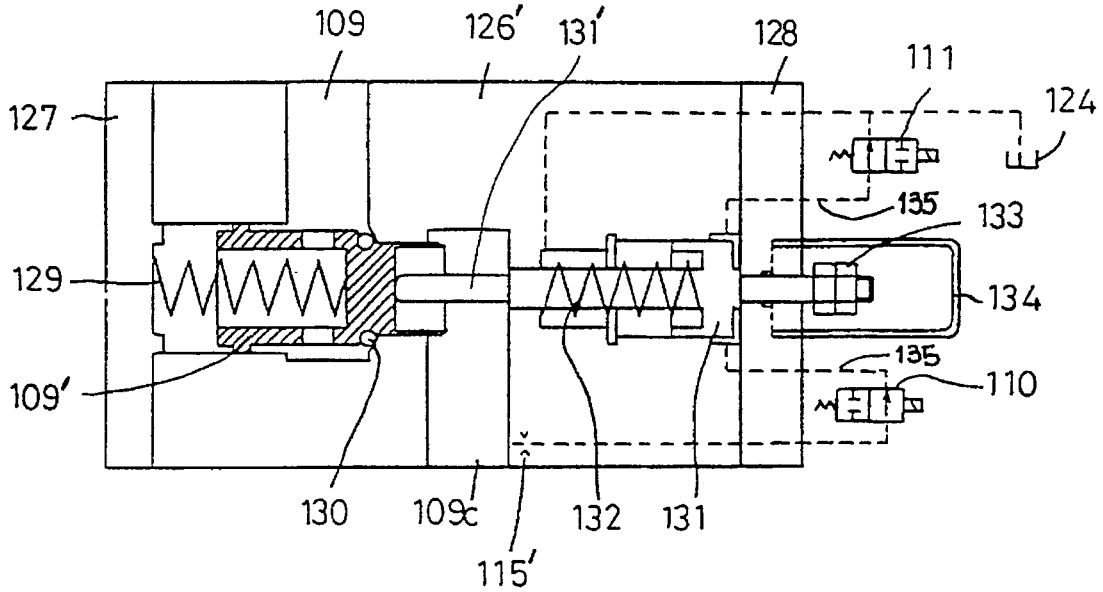

Upon the operation in the emergency, the opening solenoid valve 110 is maintained at its ON state while the closing solenoid valve 11 is maintained at its OFF state. Under this condition, the piston 131 is maintained at its right position, that is, at a state that no pressure from the hydraulic pump 121 is applied to the right end surface of the piston 131, as shown in FIG. 3D. Upon the operation in the shut-off of electric power, the closing solenoid valve 111 is automatically switched to its OFF state. In either case, accordingly, the main check valve 109 is maintained at its closed state. As a result, the control valve device of the present invention ensures the safety.

In the control valve device of the present invention, the generation of pilot pressure is not achieved unless a pressure is generated from the hydraulic pump 121 even when the opening solenoid valve 110 is switched to its ON state by a drive voltage unintentionally applied thereto. In this case, the car 100 does not descend because the main check valve 109 is not opened.

As apparent from the above description, the control valve device of the present invention can apply a pilot pressure to the opening solenoid valve only by a pressure generated from the normal/reverse rotation hydraulic pump and thereby prevents the dangerous unintentional descent of the car even when the opening and closing solenoid valves installed in vicinity of the main check valve operate abnormally. In accordance with the present invention, the soft urethane O-ring interposed between the main check valve and the manifold block prevents an internal leakage of pressurized oil in the main check valve. Since the urethane O-ring provides a perfect seal between the main check valve and the manifold block even at the stopped state of the car under a condition that the temperature of the pressurized oil is relatively high, the descent of the car does not occur under the same condition. The control valve device of the present invention also includes the manual valve for emergency descent and the minimum pressure-setting relief valve so that descent of the car can be achieved in a shut-off of electric power by manipulating the manual valve, thereby saving passengers locked up in the car from a danger. The minimum pressure to open the minimum pressure-setting relief valve is predetermined such that it corresponds to a pressure generated in the hydraulic cylinder by both the weight of the car and the weight of passengers. Accordingly, it is possible to prevent the main rope 102 from being separated from the pulley 103 due to the weight of the car 100 and thereby ensure the safety in maximum.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A control valve device for a hydraulic elevator adapted to control an oil quantity supplied to a hydraulic cylinder and an oil quantity discharged out of the hydraulic cylinder by a control of an RPM of a normal/reverse rotation hydraulic pump and thereby control ascending and descending of a car of the hydraulic elevator directly or indirectly, comprising:

a main check valve connected between the hydraulic cylinder and the hydraulic pump;

cylinder-side pressure detecting means disposed between the hydraulic cylinder and the main check valve and adapted to detect a pressure in side of the hydraulic cylinder;

pump-side pressure detecting means disposed between the main check valve and the hydraulic pump and adapted to detect a pressure in side of the hydraulic pump;

an opening solenoid valve connected between the main check valve and the hydraulic pump and adapted to receive a pilot pressure generated only from a pressure generated by the hydraulic pump and open the main check valve in response to the pilot pressure; and a closing solenoid valve connected to the main check valve and adapted to close the main check valve opened by the opening solenoid valve.

2. A control valve device in accordance with claim 1, wherein the main check valve comprises:

a movable member movably disposed in an interior of a manifold block at one side portion of the manifold block;

a first spring disposed between the movable member and a manifold block cover fixedly mounted to one end of the manifold block and adapted to always bias the movable member in a direction of closing the main check valve;

a piston disposed at the other side portion of the manifold block such that it is movable between a valve opening position and a valve closing position;

a piston rod connected to one end of the piston and adapted to push the movable member in a direction of opening the main check valve at the valve opening position of the piston;

a second spring disposed around the piston rod and adapted to always bias the piston toward the valve closing position;

a stopper nut adapted to limit a stroke of the piston; and a protection cover mounted to a manifold block cover fixedly mounted to the other end of the manifold block and adapted to protect the stopper nut.

3. A control valve device in accordance with claim 2, wherein the movable member of the main check valve has an urethane O-ring fitted around a peripheral surface of the movable member and adapted to provide a seal between the movable member and the manifold block.

4. A control valve device in accordance with claim 2, wherein the movable member of the main check valve has a plurality of slots through which a pressurized oil passes.

5. A control valve device in accordance with claim 2, wherein the stopper nut is threadedly coupled to the other end of the piston so that it adjusts the stroke of the piston and thereby an opening degree of the check valve.

6. A control valve device in accordance with claim 1, further comprising an orifice connected between the hydraulic pump and the opening solenoid valve and adapted to perform a pressure compensation.

7. A control valve device in accordance with claim 1, wherein the opening solenoid valve and the closing solenoid valve are activated when a delivery pressure of the hydraulic pump corresponds to a reference pressure in a car descending operation, so as to forcedly release a check function of the main check valve.

8. A control valve device for a hydraulic elevator adapted to control an oil quantity supplied to a hydraulic cylinder and an oil quantity discharged out of the hydraulic cylinder by a control of an RPM of a normal/reverse rotation hydraulic pump and thereby control ascending and descending of a car of the hydraulic elevator directly or indirectly, comprising:

emergency car descending means for descending the car in an emergency, the emergency car descending means comprising:

a solenoid valve for an emergency descent adapted to allow a pressurized oil from the hydraulic cylinder to be discharged to an oil tank in an emergency and thereby to descend the car, an orifice connected between the hydraulic cylinder and the solenoid valve and adapted to perform a pressure compensation, and a minimum pressure-setting relief valve adapted to allow the discharge of the pressurized oil through the solenoid valve only when a pressure of the pressurized oil is higher than a minimum pressure corresponding to the weight of the car including the weight of passengers in the car; and a pilot operating relief valve adapted to allow a pressurized oil from the hydraulic pump to be discharged to the oil tank when a delivery pressure of the hydraulic pump is higher than a predetermined pressure.

9. A control valve device in accordance with claim 8, further comprising an unloading solenoid valve connected to the pilot opening relief valve and adapted to open the pilot operating relief valve when a temperature of the pressurized oil is lower than a temperature in a rated use of the pressurized oil.

10. A control valve device in accordance with claim 8, further comprising a check valve connected between the hydraulic pump and the oil tank and adapted to prevent a cavitation from occurring when a negative pressure is generated upon a reverse rotation of the hydraulic pump.

* * * * *